US005460277A

United States Patent [19]

Silva

[11] Patent Number: 5,460,277

[45] Date of Patent: Oct. 24, 1995

[54] ORGANIZER RACK AND SYSTEM

[76] Inventor: Glenn Silva, 13932 Cranberry Ct., Wellington, Fla. 33414

[21] Appl. No.: 217,794

[22] Filed: Mar. 25, 1994

[51] Int. Cl.[6] ..... A47F 5/00

[52] U.S. Cl. ..... 211/71; 211/4; 294/162

[58] Field of Search ..... 211/71, 4, 10, 211/59.4; 294/143, 159, 161, 162, 163; 220/502, 507, 528

[56] References Cited

U.S. PATENT DOCUMENTS

| | | | |
|---|---|---|---|
| 212,886 | 3/1879 | Betjemann et al. | 211/4 |
| 1,114,080 | 10/1914 | Weil et al. | 211/71 X |
| 2,491,652 | 12/1949 | Feerick | 211/71 |
| 2,797,819 | 7/1957 | Lowmaster | 211/184 X |
| 3,993,452 | 11/1976 | Moulding | 211/4 X |
| 4,099,625 | 7/1978 | Bustos | 211/59.4 X |
| 4,852,725 | 8/1989 | Folsom | 220/507 X |
| 4,988,003 | 1/1991 | Spitzer et al. | 211/71 X |

*Primary Examiner*—Robert W. Gibson, Jr.
*Attorney, Agent, or Firm*—Kenneth E. Merklen

[57] ABSTRACT

An attache case size, portable rack is fabricated from spaced, vertical supports and spaced shelves, for holding containers. A key entry system is provided which may be used to codify the material stored in the container. A multiple lock locking system of two-element locks, with one lock element of each two-element lock mounted on the rack and the second lock element of each two-element lock mounted on the container functions to define discrete container parking spaces on the rack. The same lock elements that define a container parking space combine with lock elements on the container for locking the container in the parking space defined by those lock elements.

13 Claims, 4 Drawing Sheets

10
11a
11'
11b
11c
11d
12
13
14
15
16
17
21
22
23
25
25a
26
26a
27
28
31
4

ORGANIZER RACK AND SYSTEM

BACKGROUND OF THE INVENTION

1. Field of the Invention

The present invention relates to apparatus and a system for organizing and storing sales material for visual presentation. In particular, the present invention relates to apparatus and a system for isolating and organizing samples of materials used for a common function, but having both subtle and substantial characteristic differences, and storing such samples in a portable, visible display.

2. Prior Art

In the field of landscape gardening and landscape decorating, many of the materials used, such as mulch, sand, pebbles, gravel and/or stone, clay, loam, adobe and silt, for example, are available in their natural state in different colors and texture. The color of the materials and the texture of the materials, in the same class of materials, for example, sand, may differ one from the other, according to where the particular material is found in the environment. Often the difference between materials in the same class is very subtle and the actual materials should be seen side-by-side or seen under different lighting conditions than normally available to determine which material is the most satisfactory for the intended landscaping job or function.

The characteristics of some landscape or ground cover materials are most often unique and can be used to determine the particular region or area the material is found in nature. The style of a structure, for example, a southern plantation style house, is often associated with a particular ground cover, such as clay, for example. Persons building a particular style house often want the ground cover adjacent the house to have the characteristics that are usually associated with the particular style of the house regardless of where the house is situated.

In order to provide a handy reference of landscape ground materials available, brochures and catalogs are provided which show color photographs and renderings of the natural and other materials available. However, photographs and other pictures often fail to reveal all the true characteristics and subtle differences between materials in the same class of materials. Photographs and pictures may not always show the materials in their best light, from the point of view of the environment of intended use. Selection of landscape or ground cover materials, for indoor or outdoor use, from a brochure or catalog often results in a poor selection of landscaping materials. This often translates into an undesirable relationship between the landscape gardener or designer and the customer. The present invention overcomes this problem.

SUMMARY OF THE INVENTION

The present invention provides for the packaging of each of a plurality of landscape gardening ground samples, such as mulch, sands, clays, loam, gravel, stone and other ground cover materials, both natural and artificial, in sealed, transparent containers, preferable a transparent, clear, sealable hollow container and assembling and storing containers containing related classes of materials in a portable rack or stand for providing a portable, visible display of interchangeable containers of landscape gardening ground samples.

Preferably the containers for storing and retaining the samples of material are rectangular shaped, hollow, plastic containers, fabricated from transparent and clear material, capable of being closed and/or sealed so as to preserve the integrity of the materials contained therein and permit the materials to be transported and handled easily and conveniently. Such containers are preferably in cube shape and all the same size. Although containers in rectangular shape are preferred, other geometric shape containers, such as octagon shaped containers, for example, may be used if desired. Some advantages of a rectangular shape container over other geometric shape containers are that the larger flat surfaces of rectangular shaped containers offer stand-alone stability and large, flat surfaces offer distortion free viewing of the materials stored in the container. Among rectangular shape containers, the cube shape is preferred.

By placing the individual sample of material in a container of transparent, clear plastic material, and sealing the container closed, the integrity of the characteristics of the sample of material is preserved and the sample itself, which may otherwise be difficult to handle, may be easily and safely handled and conveniently viewed and transported. A plurality of such samples, contained in and sealed in individual containers, may be placed in close proximity with each other and the characteristics of each of the materials may be viewed and compared, without one material contaminating the other.

The individual containers may be relatively small in size but sufficiently large to hold a reasonable quantity landscape gardening or ground cover material so that one may gain a perspective of the use of such material for landscape gardening or decorating the ground or surface of an interior or exterior area. By practicing the above, a large variety of natural materials, normally difficult to handle and transport, may be easily and conveniently assembled, stored and transported for display and/or sales purposes, making it practical to bring the natural ground cover materials to the customer rather than bring the customer to storage bins where the natural ground cover materials are normally stored.

A plurality of containers, containing the various samples of natural ground cover material, for example, may be stored and/or retained in a rack or stand which may correspond in size to a conventional attache case.

The rack is preferably structured with shelves which accept a predetermined number of containers and an open framework which retains the containers on the shelves and permit viewing of the containers and the materials contained therein as well as removal of the containers for close-up inspection of the materials contained therein.

A cube shaped, hollow container having four (4) inch by four (4) inch surfaces fabricated from 1/16th to 1/8th thick transparent, clear plastic has been found to be sufficiently large to hold a respectable sample of natural ground cover material. Preferably, the cube container is made with an opening that may be opened or closed, and when closed, the container may be sealed. However, containers of other sizes and/or shapes may be used, if desired.

The size of the rack for storing and carrying a plurality of containers is largely dependent on the size of the containers used to retain the samples of materials. However, a rack having four (4) shelves, with each shelf sufficiently long to hold four (4) containers, will provide a single rack which holds sixteen (16) containers holding sixteen (16) different samples. With a single rack, the containers, and contents of each container, may be viewed from both sides of the rack while retained in the rack.

If desired, the rack may be a double rack having four (4) shelves, with each shelf capable of hold a double row of four (4) containers, thus holding eight (8) containers on each shelf. A backer board may be used to separate adjacent containers held in the double rack.

The double rack increases the number of containers retained in the rack but reduces the viewing capacity of a person viewing the containers held in the rack. Half of the containers stored on the rack may be viewed from one side of the rack and the other half of the containers stored on the rack may be viewed from the other side of the rack.

A single rack of shelves and vertical supporting struts is preferably structured in four (4) levels or shelves, to hold four (4) containers on each level or shelf. Each shelf of the rack is supported by vertical struts which contribute to the definition of discrete spaces or slots, on each shelf, in which a container is effectively "parked". A two (2) element lock locking system, between the container and the rack further defines the container parking slots or spaces and functions to lock the container in the defined parking space on the shelf.

Each shelf or level of the rack may include a keying channel or track which may be used to effectively identify or classify the container introduced onto the shelf. Unless the container has a contour that will nest in the keying channel or track on the shelf, the container can not be inserted into the shelf of the rack. The keying feature may be used to effectively classify the container to be installed on a particular shelf or level of the rack. The container which has the mating or nesting half of a two (2) piece keying arrangement, may be inserted into and retained on the shelf of the rack which has a track contoured to receive the container.

For example, shelf "A" on a rack may have a keying channel or track, for example, +A, which will accept only containers which have the key contour −A. Thus, containers having a mating or nesting contour key or stud, may be inserted into or stored on a shelf of a rack which has a keying channel or track which accepts the particular contoured key or stud, while other key contours are rejected.

The keying of containers to a particular shelf or shelves of a rack may be used to codify the containers and thus codify the materials contained in the containers stored on the shelves of the rack. The keying system may be used to codify the class of materials contained in the containers or may be used to codify the materials according to region or area from which the material contained in the container originated.

In order to retain the containers on the shelf and prevent containers from sliding out of the rack when the rack is handled and/or transported, a door covering the entrance of each shelf may be provided. The door, which closes the ends of the rack, includes a snap catch which holds the door against the opening. Alternatively, a multiple lock container locking system is provided wherein each lock of the container locking system is a two (2) element lock, such as a bolt or latch and groove lock. In this novel container locking system one of the locking elements of each two (2) element lock, for example, the groove, is mounted on the container and the other locking element of each two (2) element lock, for example, the bolt or latch, is mounted on the rack. The bolt or latch elements of each lock may be one or more spaced protuberances, such as a rib, knob, button or bump, for example, on the inside surface of the vertical supports of the rack or on the surface of the shelf of the rack and the groove elements may be one or more spaced detents, such as a groove, slot, detent or hole, located on the container, for example. A detent on the container, for example, accepts a protuberance, on the rack, for example, and effectively locks the container in a predetermined parking space on the rack.

Rack mounted lock elements combine with other rack mounted lock elements to define discrete parking spaces on the shelves of the rack, and those rack mounted lock elements which combine to define the same discrete parking space also combine with lock elements mounted on the container parked in the defined parking space, for locking the container in the rack.

A multiple lock system for defining a discrete parking space on a rack and for locking a container in the defined parking space on the rack, is provided when latch protuberances are mounted on adjacent opposite corners of the defined parking space and grooves for receiving the respective latch protuberances are mounted on opposite outside surfaces of a rectangular container designed to be received in the defined parking space on the rack. The grooves on the container are positioned so that the latch protuberances defining the parking space will nest in respective grooves when the container is in the parking space defined by the protuberances. A multiple lock system defining a discrete parking space and locking a container in the defined parking space may include combinations of four (4) latch and groove locking units or may include combinations of two (2) latch and groove locking units and two (2) vertical support elements.

When the containers are filled with samples of natural or artificial landscaping materials, the rack and the containers fitted into and retained or parked on shelves of the rack, provide an inventory of samples of landscaping materials that are convenient to transport, handle and display. The rack and the containers provide a system to bring landscaping materials into a home environment for clean, convenient and first hand display. The materials stored and sealed in the containers are easily visually displayed and are true and accurate samples of what may be provided for landscape gardening and decorating.

DETAILED DESCRIPTION OF THE INVENTION

Figures 1, 1A:
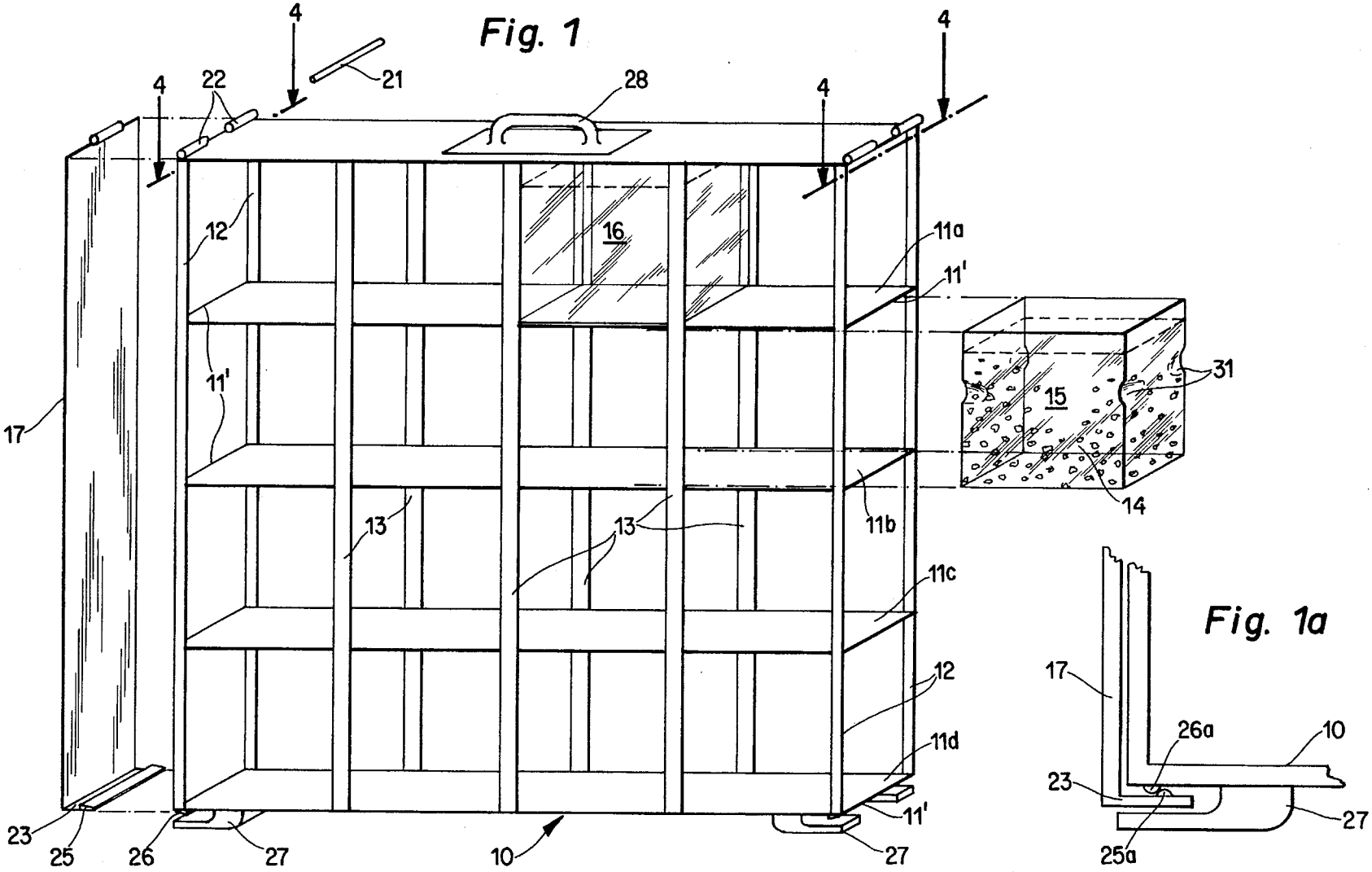
FIG. 1 is a representation, in perspective view, of the present invention.
FIG. 1*a* is a representation of an alternate snap closure for the door of the rack.

Referring to FIG. 1, an end loadable rack, 10 is represented with four (4) shelves 11*a*, 11*b*, 11*c* and 11*d*. The shelves are held in place and supported by spaced, vertical supports or struts, 12, which represent corner supports, and 13, which represent inside or internal supports. The corner struts or supports 12 are represented in more detail in FIGS. 4, 5 and 5*a* and the inside or interior struts or supports are represented in more detail in FIGS. 4, 6 and 6*a*. The area defined by the shelf width and adjacent shelves, such as 11*a* and 11*b*, for example, is sufficient to accept a container, 15, which may be inserted into the end of the rack and slid along the shelf 11*b*, for example, to a retaining or "parking" slot or space on the shelf. Parking spaces on the shelves, for the containers placed thereon, are defined by the distance or spacing between adjacent shelves and the spaced struts or supports. The corner vertical supports are positioned along the width of the shelves, leaving the ends open, and extend back from the end of the shelf. The internal vertical supports are spaced with centers approximating the ends of a container of cube shape, sized to fit between adjacent shelves reasonably snugly. The vertical supports are each sufficiently wide to capture an end portion of a container, such as 15, for example, when the container is positioned in a parking spot, as represented by container 16, on shelf 11*a*. The capturing of the end portions of the containers is clearly represented in FIG. 4, where it is assumed that the shelf is fully loaded.

The rack includes end doors, represented by door 17, which cover or close each open end of the rack. The doors are hinge connected, preferably at the top end of the rack, as represented by the hinge hardware and pin 20, 21 and 22. The end lip 23 of the door includes an extended ridge or latch 25 which rides over the tooth 26, on the bottom of the rack, which holds the door closed over the end of the rack. FIG. 1*a* represents an alternate structure for holding the door 17 closed over the end of the rack. The extended ridge, on the lip 23, may be replaced with a protuberance, such as button bump 25*a*, and the tooth 25 on the bottom of the rack may be replaced by a second protuberance or button bump 26*a*. The two (2) button bumps are positioned so that when the door is closed, the button bump 25*a*, which is in alignment with button bump 26*a*, rides over the button bump 26*a* and snaps in place, on the inside of the bump 26*a*, on the under surface of the bottom shelf 11*d*. A foot 27 is provided at each bottom corner of the rack, on which the rack may stand and which protects the snap lock arrangement.

The rack includes a carrying handle 28 by which the rack may be transported, with ease.

Preferably the rack includes a top 30 and four (4) shelves, the bottom shelf serving as the bottom of the rack. The spacing between adjacent shelves and the width of the shelves are substantially similar in distance, such as four (4) inches, for example, so that a predetermined size container, for example, a four (4) inch cube container, such as 16 may be parked in a slot or space defined by the shelves and the vertical supports supporting the shelves. The container 15 represents a container about to be inserted into the rack as represented by arrows 31, in broken line form.

The length of the shelves, end to end, is substantially equal to four (4) containers of predetermined size, so that the rack, when loaded with containers, carries a total of sixteen (16) containers. The sides of the rack are essentially open so that each container retained in the rack may be viewed from both sides of the rack.

Figure 3:
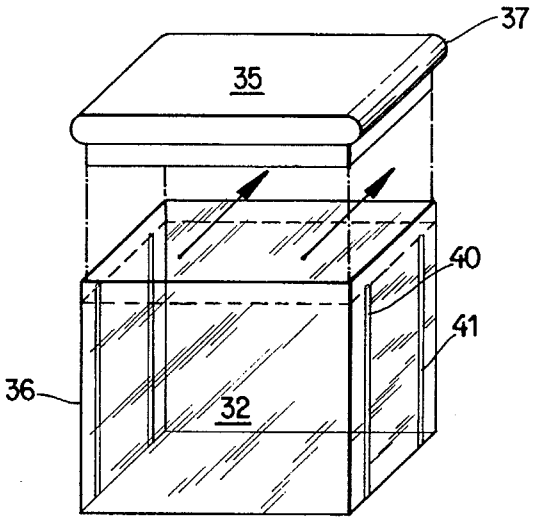
FIG. 3 is a representation, in perspective view, of a container with separated top with keying stud.
Figure 3A:
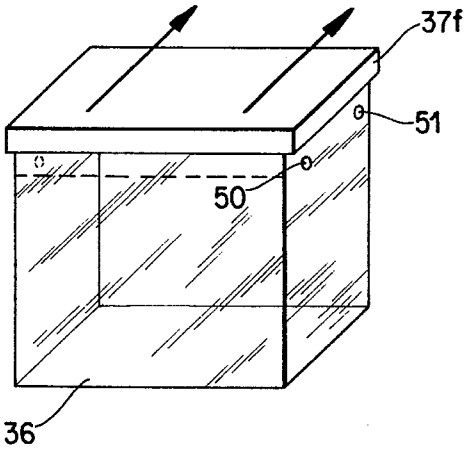
FIGS. 3*a* and 3*b* are representations of containers with tops contoured to fit into the keying channels represented in FIGS. 2*a* and 2*b*, respectively.

Preferably the containers are rectangular in form, more particularly, cubes. The containers are fabricated from a transparent, clear material such as plastic or glass, for example so that the contents of each container is clearly visible. The containers are hollow and preferably have removable tops, such as represented in FIG. 3. Preferably the hollow containers are sealable so that material, such as landscaping material, for example, sand, clay, loam or gravel may be placed in respective containers and the material sealed within the container when the top is closed. Sealing the container will preserve the integrity of the material stored in the container, and this is desirable. The broken lines on the containers 15 and 16 represent that the top of the container is closed. Sealing the containers also makes practical the transporting and handling of fluid or loose materials, for example, sand, loam, clay, gravel and other natural landscaping materials sealed in the containers.

The cube shaped container 15 is represented with finger grips 31, at its edge, the grips being useful in handling the container. Preferably the cube container is fabricated from a transparent, clear plastic material which is rigid, light in weight and reasonably unbreakable. Glass may be used if desired but it is recommended only where the material intended to be contained in the container is not compatible with plastic material. The use of plastic will minimize the cost of the container and provide a safer container, from a breakage standpoint. Although a rigid material is preferred, a flexible material may be used, if desired.

Figure 2A:
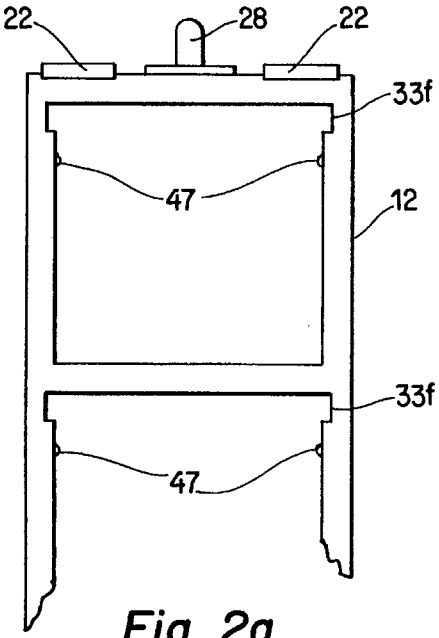
FIG. 2*a* and 2*b* are representations of alternate keying channels and protuberances shown in FIG. 2.
Figure 2:
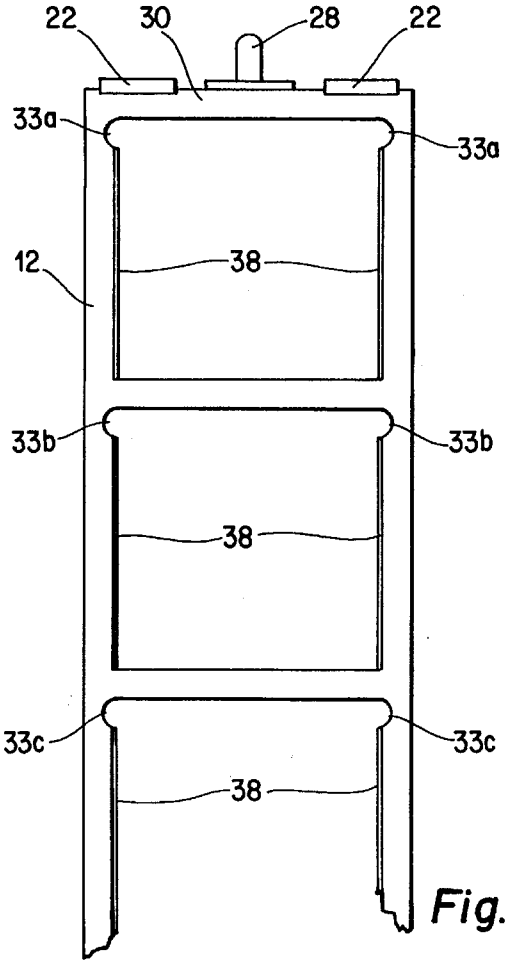
FIG. 2 is a representation, in end elevation view, of part of a rack showing keying channels and protuberances.

FIG. 2 represents part of a rack, as viewed from the end of the rack. The two (2) dimensional opening of the rack is essentially square, substantially corresponding to the height and width of the container stored therein. The upper corners of each shelf are keyed with a channel or track 33*a*, 33*b* and 33*c*. The keying channel or track is intended to limit the container accepted in the opening of the shelf to one, such as represented in FIG. 3, for example, which has upper corners that are contoured to nest in or mate with the keying channel of the shelf. When the top 35 is placed on the base or body 36 of the container, the contour of the top at 37, will fit or nest in the track 33 (a, b or c) and the container will be received on the shelf. The two (2) element keying system may be used to codify the containers and/or the material retained or contained in the container.

Along the inside surfaces of the vertical supports 12 are protuberances, represented as ribs 38. These ribs 38 are more clearly shown in FIGS. 4, 5 and 6. The protuberances are one (1) element of a two (2) element locking system for locking the containers a parking space in the rack. Protuberances are shown and described in more detail, with reference to FIGS. 2, 2*a*, 3, 3*a*, 4, 5, 5*a*, 6, 6*a*, 7, 7*a*, 9*a*, 9*b* and 10. Locking rib protuberances mounted on the corner vertical supports are offset from the shelf edge. Those mounted on the inside vertical supports are mounted along opposite edges of the support. The vertical supports are spaced along the shelves so that the centers of the protuberances substantially align with the centers of the grooves or detentes on the containers when containers are parked in a parking space on the shelf. Each protuberance 38/42 serves as a bolt or latch of a two (2) element (bolt and groove) lock, each groove or detent 40/31, on the side of the container 32, for example, serves as a groove of a two (2) element lock, into which the bolt or latch fits, to lock and hold the container in the parking space.

A preferred embodiment of rack includes corner and inside vertical supports which are connected to the shelves and hold the shelves in spaced relationship. The width of the shelves and the spacing of the supports across the shelves approximate the width of the containers. The length of the shelves is substantially equal to the length of four (4) containers. The corner vertical supports have an outside edge substantially flush with the end of the shelf. The longitudinal center of each inside support aligns with the edge of a container parked on the shelf. The spacing between protuberances on adjacent vertical supports is substantially the spacing between grooves on the same container. Preferably, the material from which the protuberances are fabricated is resilient so that resilient action of the material permits containers to pass the protuberances and latches the protuberances into a groove or detent when the protuberance is aligned with the groove.

FIG. 2*a* discloses an alternate contour keying channel or track 33*f*, from that represented in FIG. 2. The container represented in FIG. 3*a* has a top contour 37*f* which will mate with or nest in the track 33*f*.

FIG. 2*a* also discloses an alternate structure for the bolt or latch elements of the locking arrangement which includes button bump or bump protuberances 47, which may substitute for the rib protuberance 38 in FIG. 2. When button bump protuberances, such as 47 are used to serve the function of a bolt or tongue of a two (2) element locking arrangement, grooves such as 40 and 41 on container 32, in FIG. 3 or spaced detentes such as 50 on the container 36, in FIG. 3*a* may be used as receiving locking elements. However, it should be kept in mind that the spacing between adjacent ribs or adjacent button bumps and the spacing between grooves or detents should correspond so that the elements of the locking system are properly aligned and fit together to function as a lock. It will be further noted that elongated groove elements may be used satisfactorily with button or bump protuberances and with elongated rib protuberances in this locking system. Although the embodiments represented herein show the rib protuberances and the button or bump protuberances located on the rack, with the groove or detent or holes located on the container, the location of the respective locking elements may be reversed, if desired.

Figure 3B:
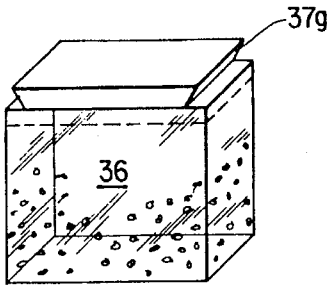
Figure 2B:
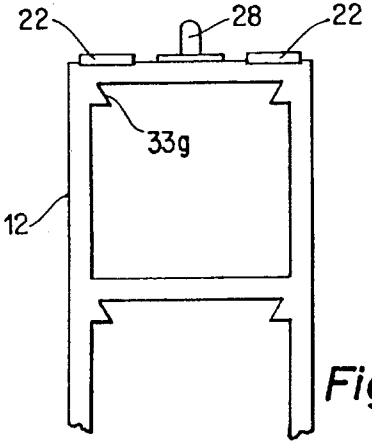

FIG. 2*b* shows part of a rack with the keying channel 33*g* in still another configuration or contour, when compared to that shown in FIGS. 2 and 2*a*. FIG. 3*b* represents a container 36 with a top corner contour 37*g* that will nest in or mate with the track 33*g* for acceptance in the keying channel 33*g*.

It should be noted that the containers 15, 16 and 36 are represented as containing material which is unidentified. The material is assumed to be landscape ground cover material used in the landscaping business. As previously indicated, the type of material that may be placed in a container has little limitation but the present invention especially useful in the landscape gardening field. It should also be noted that the locking elements of grooves or detentes and the latch protuberances may be located in the keying track and the mating corner tops of the containers, if desired.

Figure 4:
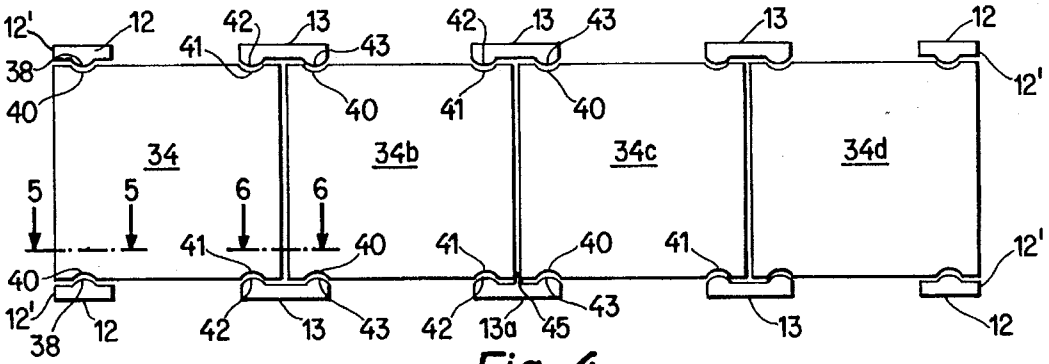
FIG. 4 is a cross section view, of the rack of FIG. 1, along the lines 4—4.
Figure 7:
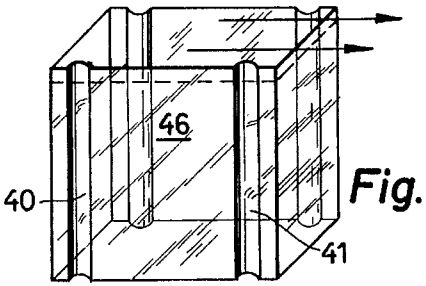
FIGS. 7 and 7*a* each represent cube containers with detent elements.
Figure 7A:
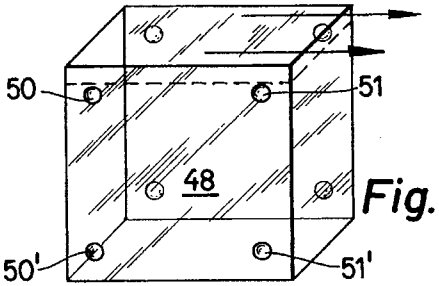
Figure 5B:
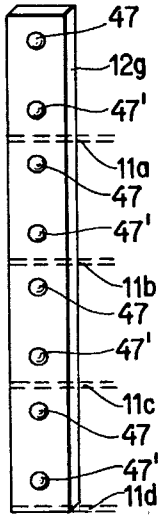
FIGS. 5*a* and 5*b* are representations of alternate forms of the protuberance represented in FIG. 5.
Figure 5A:
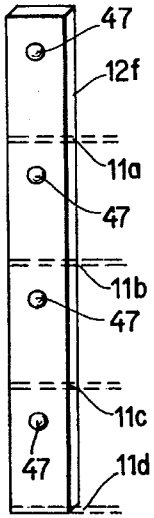
Figure 5:
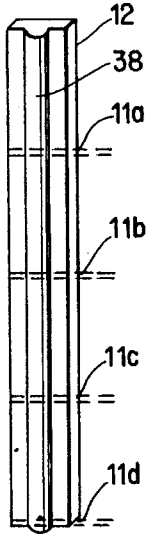
FIG. 5 is a view along the lines 5—5 on FIG. 4, showing a corner vertical support with single protuberance.

Attention is directed to FIGS. 4 and 5, each of which show that the corner vertical supports 12 has an elongated protuberance or rib 38, mounted thereon, which extends along the inside of the support. Each vertical support has width and the rib protuberance 38, mounted on the corner vertical support 12, is offset from the edge of the support adjacent the end of the shelf to which the support is attached. FIGS. 4 and 6 each show that the inside vertical supports 13 have two (2) spaced elongated protuberances or ribs 42 and 43, each mounted along opposite the outside edges respectively, of the support, and are spaced from each other. The containers 34 (b, c and d) in FIG. 4 each have grooves 40 and 41, which are also shown on the containers 32 and 46 in FIGS. 3 and 7, respectively and are similarly numbered. The grooves 40 and 41 on the containers 32, 34 (b, c and d) and 46 are located on the sides of the container and spaced so that the grooves on the same container, align with the adjacent ribs on adjacent vertical supports when a container is located in a parking space. This is shown in the cross section view of the rack and containers in FIG. 4.

FIG. 5 shows a preferred embodiment of the protuberance, in the form of an elongated rib 38, mounted on the corner vertical support 12. The elongated protuberance serves as a latch or bolt for the two (2) element lock. The elongated rib 38 is mounted offset from the edge of the corner vertical support which aligns with the edge of the shelf to which the support is attached. The shelves 11*a*–11*d* are represented in broken line form.

FIG. 6 shows the preferred embodiment of protuberance mounted on the inside vertical support 13, showing two (2) spaced, elongated rib type protuberances 42 and 43 mounted along opposite edges of the inside vertical supports. The area on the inside vertical support defined by the spaced ribs 42 and 43 will capture edges of adjacent containers parked in adjacent parking spaces on the rack. The shelves 11*a*–11*d* are represented in broken line form.

FIGS. 5*a* and 5*b* each show an alternate form of protuberance mounted on a corner vertical support. FIG. 5*a* shows a corner vertical support 12*f* on which is mounted a series of single button type or bump type protuberances 47, vertically aligned and distributed so that there is one (1) button or bump protuberance 47 on each shelf. The shelves 11*a*–11*d* are represented in broken line form. FIG. 5*b* shows a series of vertically aligned pairs of vertically aligned button type or bump type protuberances 47/47' mounted on a corner vertical support 12*g*, with one (1) pair of button type protuberances 47/47' mounted on each shelf. The shelves 11*a* and 11*b* are represented in broken line form.

Figure 6A:
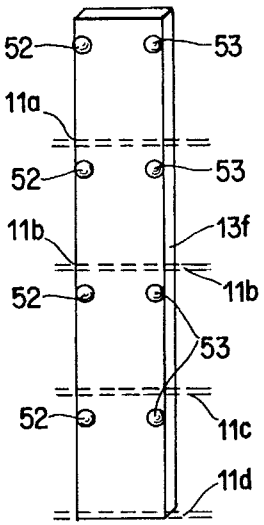
FIGS. 6*a* and 6*b* show alternate forms of the protuberances represented in FIG. 6.
Figure 6:
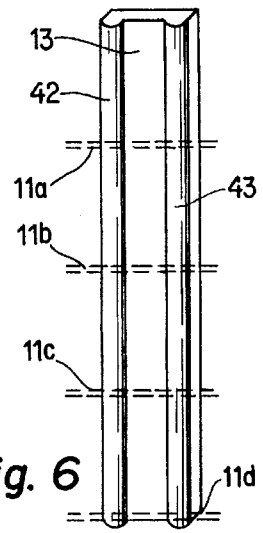
FIG. 6 is a view along the lines 6—6 on FIG. 4 showing an inside vertical support with two (2) protuberances.
Figure 6B:
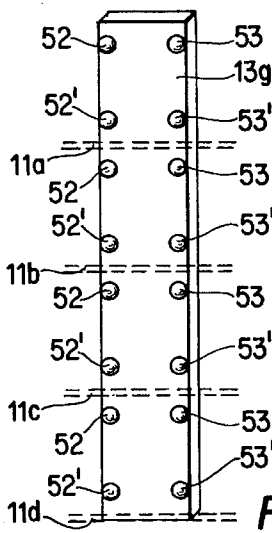

FIGS. 6*a* and 6*b* each show other alternate forms of protuberance, mounted on an inside vertical support. FIG. 6*a* shows one series of vertically aligned, single button type protuberances 52 mounted along one (1) edge of the inside vertical support 13*f* and a second series of vertically aligned single button type protuberances 53 mounted along the opposite edge of the support 13*f*. Each series of aligned button type protuberances 52 and 53 are spaced from each other.

FIG. 6*b* shows one series of vertically aligned pairs of button type protuberances 52/52' mounted along one (1) edge of the inside vertical support 13*g* and a second series of vertically aligned pairs of button type protuberances 53/53' mounted along the opposite edge of the support 13*g*. Each series of aligned pairs of button type protuberances are spaced from each other.

The protuberances, the elongated rib type 38, the single button type 47 and the pair of button type 47/47', mounted on the corner vertical support and offset from the edge of the support aligned with the end of the shelf, serve as latches or bolts of the two (2) element lock, and are received in grooves or detents on the containers, to lock the container in a parking space on a shelf of the rack. The rib type 42 and 43, the single button type 52 and 53 and the pair of button type 52/52' and 53/53', mounted along opposite edges of the inside vertical support and spaced from each other, serve as latches or bolts of the two (2) element lock, and are received in detents on adjacent containers parked in adjacent parking slots on a shelf of the rack. As shown in FIGS. 3, 3*a*, 4, 7 and 7*a*, each container includes two (2) pair of locking grooves or detents, one pair on opposite surfaces of the container, mounted so that the grooves or detents on the container, for example, will align with adjacent latches or protuberances on the rack, for example, so that the protuberances will be received in and nest in the grooves or detents and lock the container in the parking space on the rack.

Each groove or detent on the container is offset from its adjacent edge so that a portion of the container between the groove and the adjacent edge may be captured by the vertical supports of the rack, when the latching protuberance is seated in the groove.

As shown in FIG. 4, the center inside vertical support 13*a* includes a container stop 45, which functions to define the inside parking slots occupied by containers 34*b* and 34*c*, for example.

The parking spaces for containers on the shelves 11*a*, 11*b*, 11*c*, and 11*d* are defined by the vertical supports 12 and 13. The spacing between opposing vertical supports defines the depth of the parking space while the spacing between adjacent vertical supports defines the length of the parking space on the shelf. Particularly the outside edges 12' of the corner vertical supports 12 and the center line of an adjacent inside vertical support 13 define the outside parking spaces on the shelf. The center lines between adjacent inside vertical supports define the inside parking spaces on the shelf.

It becomes apparent that each container parking space on the rack is further defined by adjacent lock elements mounted on the rack. Those adjacent lock elements that define a particular container parking space combine with other lock elements, mounted on the container which is parked in that defined parking space, to lock the container in that parking space.

Protuberance latches 38 are mounted on opposing faces of the corner vertical supports 12, offset from the edge 12' of the support. Protuberance latches 42 and 43 are mounted on opposing faces of the inside vertical supports 13, along opposite edges and spaced from each other. The adjacent protuberances 38/42 and 38/42 located within the parking space occupied by container 34, for example, provide four (4) latching protuberances within one defined container parking space with the protuberances 38/38 and 42/42 in opposing positions.

The containers 34 (b, c and d), for example, each has detents or grooves 40/40 and 41/41 mounted or cut in the outside opposing sides of the container, with the grooves offset from adjacent edges, respectively. The grooves 40/40 and 41/41 are positioned on the container for receiving latch protuberances 38/38 and 42/42 respectively, when the container is in the defined parking space on the shelf.

This combination of latch protuberances on the rack and groove detents on the container translates into a multiple lock, latch and groove locking system for identifying or defining a container parking space on the rack and for locking the container in the defined parking space on the rack.

When the container is inserted into the rack, the container passes between opposing vertical supports, squeezing past the latch protuberances mounted thereon. When the container is in a defined parking space, each of the protuberances inside the defined parking space are received in correspondingly positioned grooves on the container and lock the container in the defined parking space.

This provides a multiple lock, bolt and groove locking system using four (4) locks. Alternatively a multiple lock, bolt and groove locking system using two (2) locks, may also be provided.

It was mentioned that the locking elements of grooves or detents and latches or protuberances, whether elongated or button type, may be located or mounted on either the rack or the containers, respectively. However, it is preferred that the protuberances be located on the rack and that the grooves or detents be located on the containers. The additional mass, generated by the protuberances, will add strength to the rack while the elimination of mass generated by a groove or detent will reduce the weight of the container.

FIG. 5 clearly shows that the elongated rib protuberance 38, on the corner vertical support 12, is offset from the edge of the support where the support is aligned with the edge of the shelf. FIG. 6 clearly shows that the ribs 42 and 43, on the inside vertical supports 13, are located along opposite edges of the inside vertical support with a space between the ribs. The space will capture the edges of adjacent containers parked in adjacent parking spaces. In the FIGS. 5, 5*a*, 6 and 6*a*, the shelves are represented in broken line form.

In practicing the bolt and groove locking system for defining container parking spaces and for locking containers in the defined parking space in a rack, elongate groove type detents, such as represented at 40 and 41 (FIGS. 3 and 7) and 70 (FIG. 10) may be used effectively as grooves with a variety of protuberances, such as the elongated rib type protuberances 38 (FIG. 5) and 42/43 (FIG. 6), the single button or bump type protuberances 47 (FIG. 5*a*), 52 and 53 (FIG. 6*a*), and the pairs of button or bump type protuberances 47/47' (FIG. 5*b*) and 52/52' and 53/53' (FIG. 6*b*). Pairs of hole-type detents, such as represented at 50/50' and 51/51' (FIG. 7*a*) may be used effectively as grooves with single button or bump type protuberances 47, and 52 and 53 and double button or bump type protuberances 47/47', and 52/52' and 53/53'. Single hole type detents, such as represented at 50–51 (FIG. 3*a*) may be used effectively as grooves with single button or bump type protuberances 47, and 52 and 53.

Figure 8:
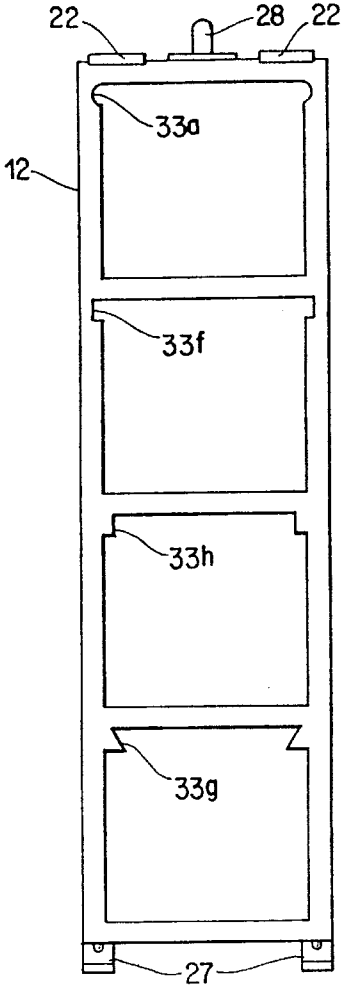
FIG. 8 a representation, in end elevation view of a rack with different keying channels.

FIG. 8 represents, in end elevation view, the end of a rack on which each shelf is keyed with a different configuration channel or track on the same rack. The different contours of channel or track are represented at 33*a*, 33*f*, 33*h* and 33*g*.

Figure 9B:
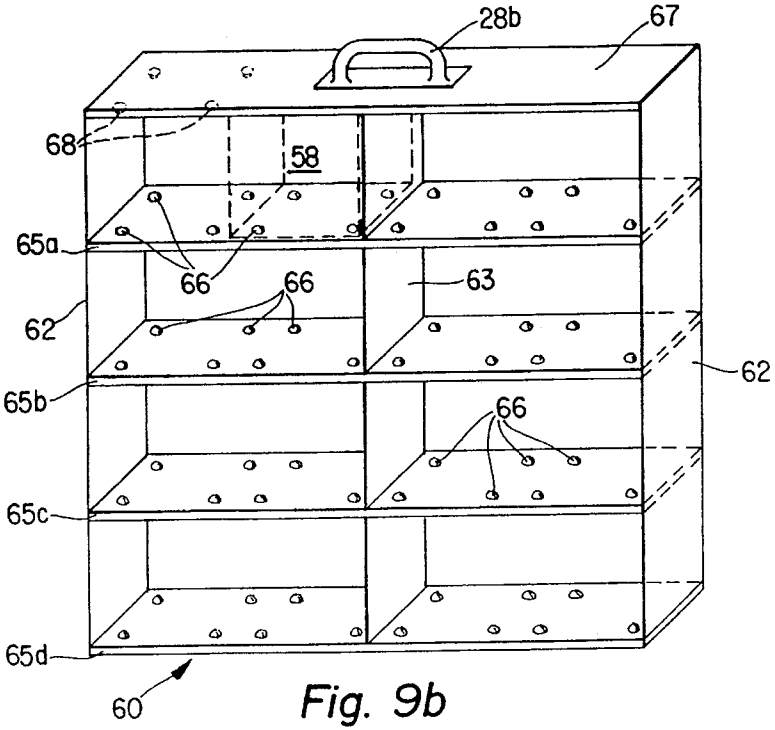
FIG. 9*b* is a representation, in perspective view, of an alternate structure of the present invention.
Figure 9A:
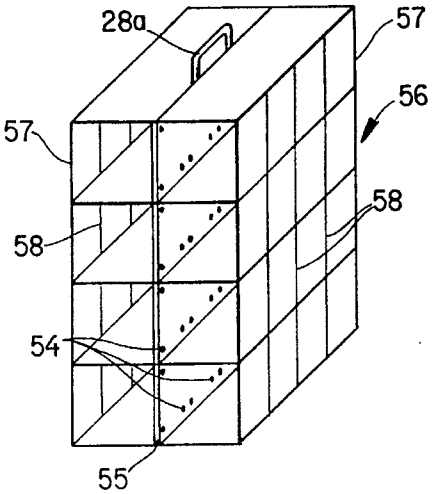
FIG. 9*a* is a representation, in perspective view, of a double rack or organizer.

FIG. 9*a* represents a double rack, having double width shelves, arranged to accept containers side-by-side, as well as one over the other. This arrangement will provide for storing thirty-two (32) containers. However, the width of each shelf is divided into two (2) parts by a partition 55. The partition separates containers parked side-by side and only one side of each container is visible from the open sides of the rack. It will be noted that button bumps 54 are located on the partition 55, while cooperating button bumps or ribs would be located on the vertical supports 57 and 58.

FIG. 9*b* represents still another embodiment of rack 60, where the rack 60 is loaded from the open sides. The rack is formed with a top 67 and carrying handle 28*b*, shelves 65*a*, 65*b*, 65*c* and 65*d*, end vertical supports 62 and central vertical support 63. Containers, one of which is represented in broken line form at 58, are inserted into the rack from the side of the rack. The rack shown in FIG. 9*b* represents that one of the elements of the two (2) element locking system for retaining the containers in the rack parking slots may be located on opposing surfaces of the shelves, that is, on the upper surface of the shelves 65*a*, 65*b*, 65*c* and 65*d* as indicated at 66 and the under or lower surface of the shelves 65*a*, 65*b* and 65*c* (and the under surface of the top 67) as represented in broken line form in at 68. The end supports 62, and the center support 63, may be in solid or sheet form.

Figure 10:
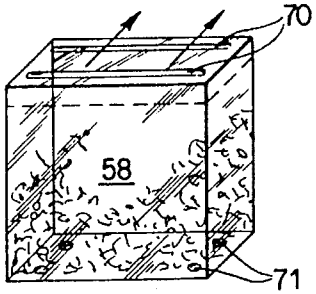
FIG. 10 is a representation, in perspective view, of a cube container adapted to be received in the rack of FIG. 9*b*.

The broken line container 58 in FIG. 9*b*, shown in more detail in FIG. 10, shows that the groove or detent elements of the locking system may be located on the top and the bottom of the container, and that either the groove 70 or the hole detent 71 may be used interchangeably.

Thus, a preferred embodiment of the invention has been shown and described. In addition, several alternate embodiments of the organizer rack have been shown and described along with alternate structure for locking containers in the organizer rack. Further, several alternate configurations and techniques for codifying containers stored in the rack have been shown and described. Changes and modifications, in addition to those shown and described herein may be made in the invention, as will become apparent to those skilled in the art, without departing from the invention.

What is claimed is:

1. A hand carryable organizer system for storing and automatically locking a container in a discrete parking space on a rack, said hand carryable organizer system comprising:

a) a rack defined by a plurality of spaced shelves supported by a plurality of spaced vertical support members, each vertical support member of said plurality of vertical support members connected to each shelf of said plurality of shelves for maintaining a uniform spacing between shelves, said uniform spacing between shelves for defining a first dimension of a container of a plurality of containers adapted to be received in said rack, each said shelf having a first width, said first width defining a second dimension of said container, adjacent said vertical support members spaced for defining a third dimension of said container;

b) a multiple lock locking means defined by a plurality of two-element locks for defining a discrete container parking space on said rack and for locking said container in said discrete container parking space, a first lock element of each two-element lock of said plurality of two-element locks mounted on said rack and a second element of each said two-element lock mounted on said container;

c) selected adjacent said first lock elements combining for defining said discrete container parking space on said rack; and, d) said selected adjacent said first lock elements combining with said second lock elements on said container parked in said discrete parking space for locking said container in said discrete container parking space.

2. A hand carryable organizer system as in claim 1 and in which said two-element lock includes a bolt and a groove and said bolt is mounted on said rack and said groove is mounted on said container.

3. A hand carryable organizer system as in claim 1 and in which each two element lock of is a bolt and a groove lock and each said groove is mounted on said rack and each said bolt is mounted on said container.

4. A hand carryable organizer system as in claim 1 wherein said first plurality of first lock elements which combine for defining said discrete container parking space are adjacent first lock elements.

5. A hand carryable organizer system as in claim 2 where in said bolt is an elongated protuberance mounted on said vertical support member and said groove is an elongated detent mounted on said container.

6. A hand carryable organizer system as in claim 2 wherein said bolt is a bump protuberance mounted on said vertical support member and said groove is a hole detent mounted on said container.

7. A hand carryable organizer system as in claim 1 and in which said first lock element of each two-element lock is mounted on said vertical support member.

8. A hand carryable organizer system as in claim 1 and in which said first lock element of each two-element lock is mounted on said shelf.

9. A hand portable organizer system for retaining and locking a container in a discrete parking space on a rack, said organizer system comprising:

a) a rack defined by a plurality of spaced shelves, said spaced shelves supported by a plurality of spaced vertical support members, each vertical support member of said plurality of vertical support members connected to each shelf of said plurality of shelves for maintaining a uniform spacing between shelves, said uniform spacing between shelves for defining a first dimension of said container, each said shelf having a first width, said first width defining a second dimension of said container and defining spacing between first adjacent vertical support members, second adjacent vertical support members spaced by a second spacing, said second spacing defining a third dimension of said container;

b) a multiple lock locking means including a plurality of two-element locks, each two-element lock of said multiple lock locking means having a first lock element and a second lock element, each said first lock element mounted on said rack and each said second lock element mounted on said container;

c) a select plurality of said first lock elements for defining said discrete parking space on said shelf, said select plurality of said first lock elements combining with said second lock elements on said container, when said container is in said discrete parking space, for locking said container in said discrete parking space.

10. A hand portable organizer system as in claim 9 and in which said two-element lock is a bolt and groove lock and said first lock element is a bolt.

11. A hand portable organizer system as in claim 9 and in which said two-element lock is a bolt and groove lock and said first lock element is a groove.

12. A hand portable organizer system as in claim 9 and in which said first lock element of each said two-element lock of said multiple lock locking means is mounted on said vertical support member.

13. A hand portable organizer system as in claim 9 and in which said first lock element of each said two-element lock of said multiple lock locking means is mounted on said shelf.

* * * * *